United States Patent [19]

Munari

[11] 4,274,915

[45] Jun. 23, 1981

[54] PROCESS FOR MANUFACTURING HEAT-SEALED PROOFED PAPER OR CARD ON A FOURDRINIER MACHINE

[76] Inventor: Giovanni Munari, Camposampiero (Padova), Italy

[21] Appl. No.: 2,164

[22] Filed: Jan. 9, 1979

[30] Foreign Application Priority Data

Jan. 13, 1978 [IT] Italy ..... 3308 A/78

[51] Int. Cl.[3] ..... D21F 11/04; D21F 5/20

[52] U.S. Cl. ..... 162/129; 162/132; 162/146; 162/206; 100/93 RP

[58] Field of Search ..... 162/129, 146, 132, 198, 162/206, 207; 100/93 RP

[56] References Cited

U.S. PATENT DOCUMENTS

| | | | |
|---|---|---|---|
| 3,350,260 | 10/1967 | Johnson | 162/146 X |
| 3,795,575 | 3/1974 | Gouw | 162/146 |
| 3,816,941 | 6/1974 | Holik et al. | 162/207 X |
| 4,016,030 | 4/1977 | Sobota | 162/206 X |
| 4,089,738 | 5/1978 | Kankaanpaa | 162/206 |
| 4,212,703 | 7/1980 | D'Amico et al. | 162/129 |

FOREIGN PATENT DOCUMENTS

| | | | |
|---|---|---|---|
| 45-31683 | 10/1970 | Japan | 162/146 |

*Primary Examiner*—Richard V. Fisher
*Attorney, Agent, or Firm*—Martin A. Farber

[57] ABSTRACT

A process for manufacturing heat-sealed proofed paper solely using a Fourdrinier machine for paper or card with one or more layers, wherein the paper or card leaving the dry section of the Fourdrinier machine, forms a continuous layer with heat-sealing and impermeable properties, by utilizing polyolefin synthetic fibers in a layer scattered uniformly and heated at the top surface of the layer to around melting temperature of the polyolefin fibers in a further heating step after a drying step. Then the polyolefin layer while close to the melting temperature of the polyolefin fibers is pressed between calender rollers until interpenetration and contact has taken place, and then cooled at the exit of the calender rollers.

7 Claims, 1 Drawing Figure

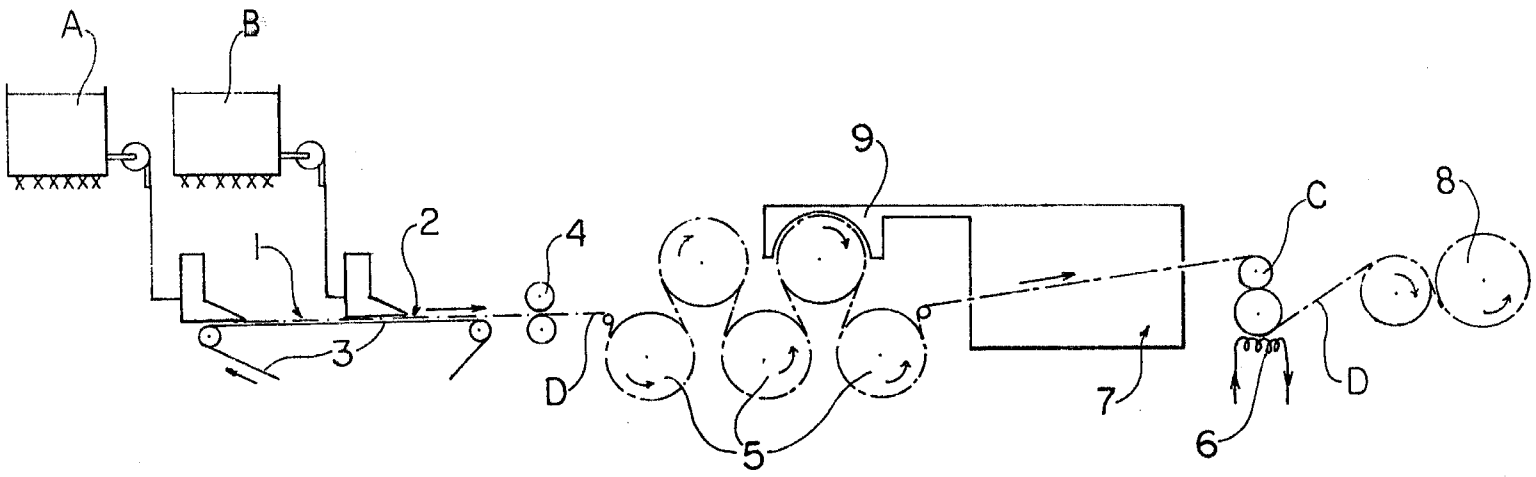
A
B
1
2
3
4
5
6
7
8
9
C
D
D

PROCESS FOR MANUFACTURING HEAT-SEALED PROOFED PAPER OR CARD ON A FOURDRINIER MACHINE

This invention relates to a process for manufacturing heat-sealed proofed paper or card on a Fourdrinier machine.

As is known, the preparation of proofed paper or card is currently achieved through an impervious polyethylene, PVC or similar film being bonded to a previously prepared paper base.

The said procedure requires subsequent processing stages and special machinery.

The object of the present invention is to enable heat-sealed proofed paper or card to be produced on one single machine in one single operation, since a close interpenetration exists between the various fibres that go to make up the finished integral product.

Another object of the present invention is for the paper or card to have at least one surface having impermeability characteristics of the same type and to the same extent as attained with a polyethylene or similar facing on the sheet, yet be free from the flaws caused by coupling together layers of different prefabricated materials.

A further object still of the present invention is to manufacture cheaply paper or card having the characteristics enumerated above, due to the use of polyolefin fibres, even re-utilized, to a reduced extent, suitably distributed across the sheet.

These and other objects too, such as a saving in thermal power compared to treatment not on a Fourdrinier machine, are achieved with the process outlined below.

Use is made of a Fourdrinier machine and of the relevant pulp preparation plant, of the type for paper or card in at least two layers. This process is to be preferred, although it is possible to perform the same innovatory process to make one layer paper or card. The pulp for the layer that constitutes the part to be proofed is a mixture of cellulose and polyolefin fibres or similar, kneaded and fed in a conventional way.

The pulp used for the base layer, be this single or multiple, is of the customary cellulose type.

The percentage of synthetic fibres with respect to others in the same layer can vary from 40% to 80%, depending on the final characteristics required.

It is important for the layer in question to be bonded well to the one facing it and this is an interpenetration that can be achieved with the use, for example, of a Fourdrinier machine with one wire and two feed tanks.

The composite sheet that leaves the wire is then subjected to the usual treatment in the wet and dry sections of the Fourdrinier machine, up to the area preceding the calender.

At this juncture, it is necessary for the side of the sheet that has to be proofed, or for both sides if the sheet is of the single layer type, to attain a suitable temperature. In addition to the normal machine driers, a heating system is installed for this purpose, which is able to supply the necessary heat, through radiation, conduction or some other means, with which to achieve the said temperature.

The sheet then passes into the calender at high temperature, exits therefrom and is rewound. The best result is obtained by cooling at least one of the rollers of the calender and adopting fairly high compression pressures.

During the compression operation, the completion occurs of the uniform distribution of the polyolefin material, this being close to melting, and of its penetration between the cellulose fibres until a layer in which there is no break in continuity is formed.

The subsequent cooling freezes the said system, stops it from being viscous and makes it possible to produce a roll of paper or card in a customary condition.

The finished sheet has one side at least that is as impermeable as a sheet made on a different machine with either the application of a synthetic layer of ordinary paper or a treatment similar to the one described herein used on various materials.

When the same process is used to produce single layer paper or card, both sides of the sheet are proofed to the same extent, and although this can, in some case, be useful, it is not generally necessary.

Other objects and advantages will emerge from the description that follows and from the accompanying drawing, in which an industrial paper making plant employing the manufacturing process according to the present invention used to produce, for example, two layer paper, is illustrated diagrammatically by way of an example.

With reference to the said drawing, the conventional pulp for two separate mixes is contained in the two tanks A and B of the machine.

The paper making machine is of the type having one wire and two feed tanks. On the base layer 1, the weight of which in grams per square meter is greater, which is formed after the first tank A, the second tank B places the second mix containing 60% polyolefin fibres. The support wire 3 transfers the two layers 1 and 2 of mix towards the wet presses 4 and the driers 5 which prior to the calender 6 produce a web of normal type paper, with the maximum temperature being over 100° C.

Between the final drier 5 with the steam on at full, and the dry calender 6, a gas operated hot air hood 7 is installed, and this is able to raise the temperature of the top side of the sheet up to the predetermined temperature.

The said temperature regulation makes it possible for the sheet to be inserted between the rollers of the dry calender C with the polyolefin fibres in a condition close to their melting point.

The compression pressure of the rollers C is regulated mainly to suit the speed of the machine, and is proportional thereto.

The bottom of the sheet adjacent at least one of the rollers C is cooled with circulating water via cooling coils 6 in order to lower the temperature of the paper leaving the calender (thereby defining an exit position located 180° away and with reverse horizontal direction traveling of the combined layer from that of the pressing location by about half of a lower of the rollers of the dry calender) and to bring it down to normal values for rewinding on to the reels 8.

The hot air discharged is utilized in a hood 9 to be blown on the top side of the layers as they run about an upper 180° section of one of the drying rollers 5 and this enables a considerable amount of heat to be recovered.

The roll of paper or card D is immediately available with definitive heat-sealing and impermeable properties.

The present invention, illustrated and described schematically as an example, is understood to be extensible to all ancillary variants which, as such, fall within the framework of the protection afforded to the claims listed below.

I claim:

1. A process for the production of heat-sealed, proofed, paper with a Fourdrinier machine, comprising the steps of feeding a base layer of cellulose fibers onto a traveling support wire, feeding a mix containing cellulose and approximately 60% polyolefin fibers distributed uniformly on top of the base layer to form two layers on the traveling support wire, pressing the support wire and both layers while wet, drying the pressed layers with steam over a plurality of drying rollers to a temperature above 100° C., further regulating and heating the top side of the layers, namely the mix containing the cellulose and approximately 60% polyolefin fibers, up to a predetermined temperature which is close to the melting point of the polyolefin fibers, inserting the layers between rollers of a dry calender while the polyolefin fibers are still at the temperature close to their melting point, compressing the layers at substantially high pressures at a pressing location between the rollers of the dry calender near the predetermined temperature close to the melting point of the polyolefin fibers such that the uniformly distributed polyolefin fibers interpenetrate between the cellulose fibers in the base layer until a combined continuous layer with heat sealing and impermeable properties is formed and substantially simultaneously but thereafter cooling a free side of said combined continuous layer, said free side then not contacting the rollers, while said top side is still contacting one of the rollers of the dry calender, with circulating water at an exit position from the rollers of the dry calender remote from the pressing location in order to then lower the temperature of the combined continuous layer leaving the dry calender and to bring the temperature down to normal values, and winding the combined continuous layer on reels.

2. The process as set forth in claim 1, wherein the step of further heating the top side of the layers comprises using hot air.

3. The process as set forth in claim 1, wherein the exit position is located 180° away and with reverse horizontal direction traveling of the combined layer from that of the pressing location by about half of a lower of the rollers of the dry calender.

4. A process for the production of heat-sealed, proofed, paper with a Fourdrinier machine, comprising the steps of feeding a base layer of cellulose fibers onto a traveling support wire, feeding a mix containing cellulose and apporximately 60% polyolefin fibers distributed uniformly on top of the base layer to form two layers on the traveling support wire, pressing the support wire and both layers while wet, drying the pressed layers with steam over a plurality of drying rollers to a temperature above 100° C., further regulating and heating the top side of the layers, namely the mix containing the cellulose and approximately 60% polyolefin fibers, up to a predetermined temperature which is close to the melting point of the polyolefin fibers, inserting the layers between rollers of a dry calender while the polyolefin fibers are still at the temperature close to their melting point, compressing the layers at substantially high pressures at a pressing location between the rollers of the dry calender near the predetermined temperature close to the melting point of the polyolefin fibers such that the uniformly distributed polyolefin fibers interpenetrate between the cellulose fibers in the base layer until a combined continuous layer with heat sealing and impermeable properties is formed and substantially simultaneously but thereafter cooling a free side of said combined continuous layer, said free side then not contacting the rollers, while said top side is still contacting one of the rollers of the dry calender, with circulating water at an exit position from the rollers of the dry calender which is remote from the pressing location in order to then lower the temperature of the combined continuous layer leaving the dry calender and to bring the temperature down to normal values, winding the combined continuous layer on reels, and simultaneously regulating the compression pressure of the rollers of the dry calender proportional to a speed of the traveling support wire.

5. A process for the production of heat-sealed, proofed, paper with a Fourdrinier machine, comprising the steps of feeding a base layer of cellulose fibers onto a traveling support wire, feeding a mix containing cellulose and approximately 60% polyolefin fibers distributed uniformly on top of the base layer to form two layers on the traveling support wire, pressing the support wire and both layers while wet, drying the pressed layers with steam over a plurality of drying rollers to a temperature above 100° C., further regulating and heating the top side of the layers, namely the mix containing the cellulose and approximately 60% polyolefin fibers, up to a predetermined temperature which is close to the melting point of the polyolefin fibers, inserting the layers between rollers of a dry calender while the polyolefin fibers are still at the temperature close to their melting point, compressing the layers at substantially high pressures at a pressing location between the rollers of the dry calender near the predetermined temperature close to the melting point of the polyolefin fibers such that the uniformly distributed polyolefin fibers interpenetrate between the cellulose fibers in the base layer until a combined continuous layer with heat sealing and impermeable properties is formed and substantially simultaneously but thereafter cooling a free side of said combined continuous layer, said free side then not contacting the rollers, while said top side is still contacting one of the rollers of the dry calender, with circulating water at an exit position from the rollers of the dry calender remote from the pressing location in order to then lower the temperature of the combined continuous layer leaving the dry calender and to bring the temperature down to normal values, winding the combined continuous layer on reels, the step of further heating the top side of the layers comprising using hot air, and removing a portion of discharged hot air after it has heated the top side of the layers and blowing this discharged hot air to adjacent one of the drying rollers to further dry the pressed layers in the preceding step of drying the pressed layers.

6. The process as set forth in claim 5, wherein the discharged hot air heats the top side of the pressed layers as the pressed layers run about an upper 180° sector of said one of the drying rollers.

7. A process for the production of heat-sealed, proofed, paper with a Fourdrinier machine, comprising the steps of feeding a base layer of cellulose fibers onto a traveling support wire, feeding a mix containing cellulose and approximately 60% polyolefin fibers distributed uniformly on top of the base layer to form two layers on the traveling support wire, pressing the support wire and both layers while wet, drying the pressed layers with steam over a plurality of drying rollers to a temperature above 100° C., further regulating and heating the top side of the layers, namely the mix containing the cellulose and approximately 60% polyolefin fibers, up to a predetermined temperature which is close to the melting point of the polyolefin fibers, inserting the layers between rollers of a dry calender while the polyolefin fibers are still at the temperature close to their melting point, compressing the layers at substantially high pressures and at a pressing location between the rollers by the rollers of the dry calender near the predetermined temperature close to the melting point of the polyolefin fibers such that the uniformly distributed polyolefin fibers interpenetrate between the cellulose fibers in the base layer until a combined continuous layer with heat sealing and impermeable properties is formed and substantially simultaneously but thereafter cooling a free side of said combined continuous layer, said free side then not contacting the rollers, while said top side is still contacting one of the rollers of the dry calender, with circulating water at an exit position from the rollers of the dry calender remote from the pressing location in order to then lower the temperature of the combined continuous layer leaving the dry calender and to bring the temperature down to normal values, winding the combined continuous layer on reels, and wherein the compressing step is performed without additional heating.

* * * * *